US005452577A

United States Patent [19]

Langer

[11] Patent Number: 5,452,577

[45] Date of Patent: Sep. 26, 1995

[54] EXHAUST GAS SYSTEM FOR AN INTERNAL COMBUSTION ENGINE

[75] Inventor: Hans-Joachim Langer, Remseck, Germany

[73] Assignee: Daimler-Benz A.G., Stuttgart, Germany

[21] Appl. No.: 228,149

[22] Filed: Apr. 15, 1994

[30] Foreign Application Priority Data

Apr. 30, 1993 [DE] Germany ..... 43 14 204.4

[51] Int. Cl.[6] ..... F01N 3/28; F01N 3/00

[52] U.S. Cl. ..... 60/299; 60/302; 181/252; 181/256; 422/180

[58] Field of Search ..... 60/302, 299; 181/252, 181/256

[56] References Cited

U.S. PATENT DOCUMENTS

| | | | |
|---|---|---|---|
| 3,166,895 | 1/1965 | Slayter | 60/302 |
| 3,233,699 | 2/1966 | Plummer | 181/252 |
| 3,744,589 | 7/1973 | Mellin | 181/256 |
| 4,353,208 | 10/1982 | Volker | 60/302 |
| 4,529,060 | 7/1985 | Komauer | 181/252 |
| 4,596,306 | 6/1986 | Abe | 181/252 |
| 4,646,516 | 3/1987 | Bostok | 60/302 |

*Primary Examiner*—Douglas Hart
*Attorney, Agent, or Firm*—Klaus J. Bach

[57] ABSTRACT

In an exhaust gas system for an internal combustion engine for a vehicle which includes an exhaust gas conduit with an exhaust gas cleaner and a silencer, the structure-borne noise emission is reduced by coating surface areas of the exhaust system with a silencing layer consisting of metal powder which is applied by plasma spraying or sintering.

10 Claims, 1 Drawing Sheet

EXHAUST GAS SYSTEM FOR AN INTERNAL COMBUSTION ENGINE

BACKGROUND OF THE INVENTION

The invention relates to an exhaust gas system for an internal combustion engine of a vehicle, having an exhaust gas conduit including at least one silencer and, if required, at least one exhaust gas cleaner.

An exhaust gas system of this type is known from the German journal "MTZ Motortechnische Zeitschrift 54 (1993) 4", pages 202 to 206. In this system, the exhaust gas conduit, the catalyzer casing and the silencer are all single-walled. A disadvantage of such an arrangement is the relatively high structure-borne noise emission or secondary noise emission so that, overall, the exhaust gas system noise is relatively high.

A reduction in the exhaust gas system noise can, for example, be achieved by making the exhaust gas conduit or catalyzer casing or silencer double-walled, as it is known from the German Offenlegungsschrift 38 34 403 which discloses a double-galled catalytic converter casing. A disadvantage of this arrangement however is the relatively high weight and the consumption of additional material.

The object of the present invention is to improve the exhaust gas system of the known type in such a way that a drastic reduction in the structure-borne noise emission or secondary air noise emission is achieved with a relatively small expenditure of additional material while retaining a single-walled arrangement.

SUMMARY OF THE INVENTION

In an exhaust gas system for an internal combustion engine for a vehicle which includes an exhaust gas conduit with en exhaust gas cleaner end a silencer, the structure-borne noise emission is reduced by coating surface areas of the exhaust system with a silencing layer consisting of metal powder which is applied by plasma spraying or sintering.

With this arrangement a drastic reduction in the emission of structure-borne noise, and therefore an effective noise reduction for the exhaust gas system, is achieved while a single-walled design is retained. This is achieved by coating the complete exhaust gas system or only portions of its surfaces. Because the weight of the silencing layer amounts to only a small part of the weight of a second casing, the single-walled exhaust gas system according to the invention is lighter than a double-walled exhaust gas system yet provides for at least as good a reduction of structure-borne noise emission.

An additional advantage resides in the fact that the silencing layer can be specifically applied to locations in the exhaust gas system which are particularly critical with respect to vibration so that an optimum exhaust gas system can be achieved with respect to weight end structure-borne noise emission.

In accordance with one configuration of the invention, the silencing layer consists of a metal powder applied by means of plasma spraying or sintering to the pipe wall and/or casing wall of the exhaust gas system. Depending on the application, the silencing layer can be applied to the inner surface and/or outer surface of the pipe wall or casing wall.

Where the silencing layer is applied to the inner surface of the exhaust gas conduit and/or silencer casing or catalytic converter casing, it is, finally, also possible to improve the catalytic effect overall by impregnating the layer with a catalytic material.

Various possibilities for coating an exhaust gas system are explained in more detail below on the basis of the drawings.

DESCRIPTION OF PREFERRED EMBODIMENTS

As shown in each of FIGS. 1 to 4, a single-walled exhaust gas conduit 1 includes a straight conduit section followed by a curved conduit section so as to be approximately S-shaped and to which is connected a catalytic converter casing 2 which is also single-walled. A silencer casing can be substituted for the catalytic converter casing 2.

Figure 1:
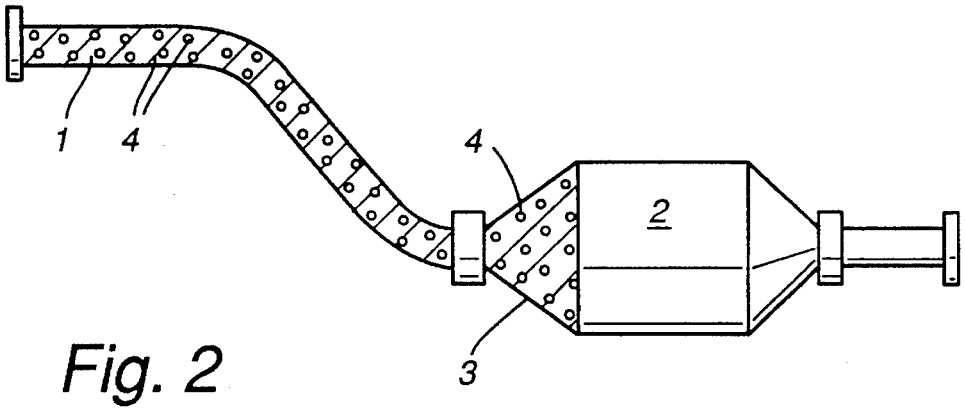
FIGS. 1 to 4 show an exhaust system with various portions of the system coated with silencing layers to reduce the emission of noises therefrom.

In accordance with FIG. 1, the complete exhaust gas conduit 1 and the inlet-end casing funnel 3 of the catalytic converter casing 2 are provided with a silencing layer 4 consisting of metal powder, the silencing layer 4 being indicated by thin oblique lines. The coating can be applied to the outer surface of the exhaust gas conduit 1 and of the casing funnel 3 but it can alternatively be applied to their inner surfaces or to both the inner and outer surfaces. The silencing layers can be applied by sintering or plasma spraying. It is also possible to apply silencing layers of different thicknesses to the exhaust gas conduit 1 and the casing funnel 3. The silencing layer preferably consists of the same metal as the exhaust gas conduit or the catalytic converter casing 2. Where the silencing layer 4 is applied to the inner surface, it can also be impregnated with a catalytic material in order to improve the catalytic effect.

Figure 2:
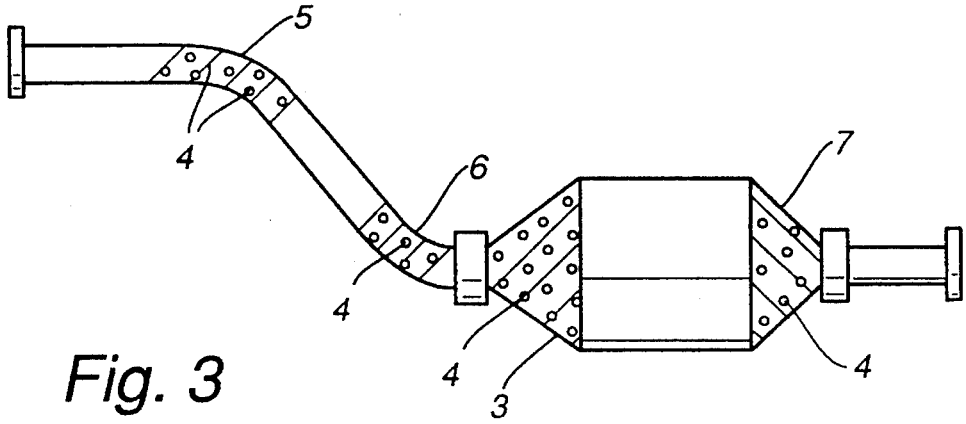

In the case of FIG. 2, only the bend sections 5 and 6 of the exhaust gas conduit 1 and the casing inlet funnel 3 and the outlet-end casing funnel 7 of the catalytic converter casing are provided with a silencing layer 4. Further variations of the coating in accordance with FIG. 1 are possible.

Figure 3:
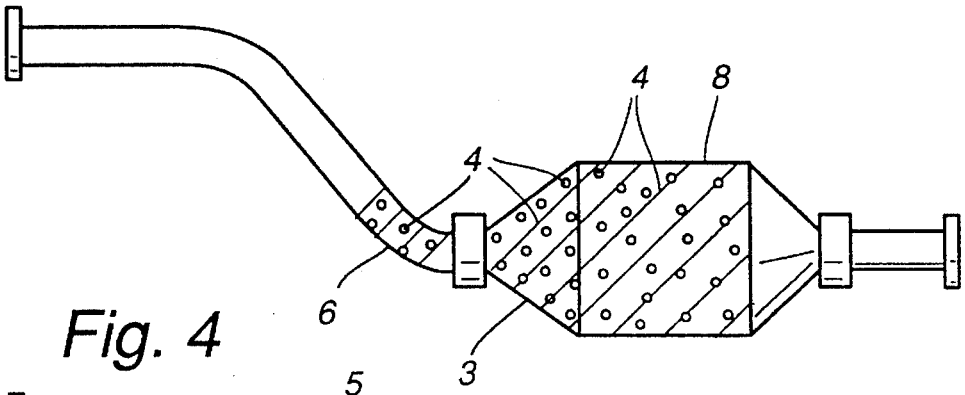

In the case of FIG. 3, the bend section 6, the casing funnel 3 and the casing central part 8 are provided with the silencing layer, further variations of the coating in accordance with FIG. 1 being likewise possible.

Figure 4:
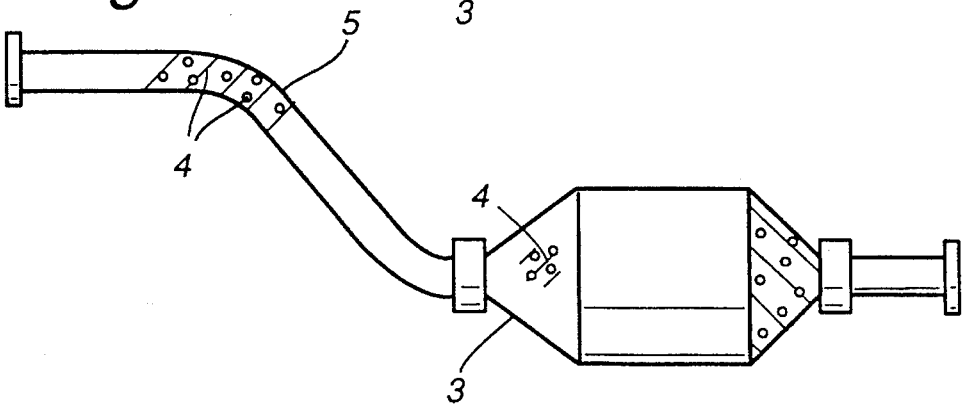

FIG. 4 shows an embodiment with distinct local silencing layer arrangements on the bend section 5 and on the casing funnel 3 in association with full-area coatings of the outlet-end casing funnel 7, further variations of the coating in accordance with FIG. 1 being again possible also in this case.

What is claimed is:

1. An exhaust gas system for an internal combustion engine of a vehicle, including an exhaust gas conduit having exhaust system components including at least one of a silencer and an exhaust gas cleaner, said exhaust gas conduit and said system components being provided at least partially with a silencing layer for noise silencing, said silencing layer consisting of a metal powder which is applied, by plasma spraying to surface portions of said exhaust gas conduit and said system components.

2. An exhaust gas system according to claim 1, wherein said silencing layer is applied to an inner surface of said system components and the exhaust gas conduit.

3. An exhaust gas system according to claim 1, wherein said silencing layer is applied to an outer surface of the exhaust gas conduit and the system components.

4. An exhaust gas system according to claim 1, wherein said silencing layer is applied to the inner surface of a catalytic converter used as the exhaust gas cleaner and wherein said silencing layer is impregnated with a catalytic material.

5. An exhaust gas system according to claim 1, wherein said silencing layer is applied to inner and outer surfaces of said system components.

6. An exhaust gas system for an internal combustion engine of a vehicle, including an exhaust gas conduit having exhaust system components including at least one of a silencer and an exhaust gas cleaner, said exhaust gas conduit and said system components being provided at least partially with a silencing layer for noise silencing, said silencing layer consisting of a metal powder which is applied, by sintering, to surface portions of said exhaust gas conduit and said system components.

7. An exhaust gas system according to claim 6, wherein said silencing layer is applied to an inner surface of said system components and the exhaust gas conduit.

8. An exhaust gas system according to claim 6, wherein said silencing layer is applied to an outer surface of the exhaust gas conduit and the system components.

9. An exhaust gas system according to claim 6, wherein said silencing layer is applied to the inner surface of a catalytic converter used as the exhaust gas cleaner and wherein said silencing layer is impregnated with a catalytic material.

10. An exhaust gas system according to claim 6, wherein said silencing layer is applied to inner and outer surfaces of said system components.

* * * * *